US006412665B1

(12) United States Patent
Taghavi-Khanghah

(10) Patent No.: US 6,412,665 B1
(45) Date of Patent: Jul. 2, 2002

(54) CONTAINER VALVE

(75) Inventor: Said Taghavi-Khanghah, Newcastle Upon Tyne (GB)

(73) Assignee: Veresk Biosystems Limited, Newcastle on Tyne (GB)

( * ) Notice: Subject to any disclaimer, the term of this patent is extended or adjusted under 35 U.S.C. 154(b) by 0 days.

(21) Appl. No.: 09/762,213

(22) PCT Filed: Jul. 30, 1999

(86) PCT No.: PCT/GB99/02523

§ 371 (c)(1),
(2), (4) Date: Feb. 5, 2001

(87) PCT Pub. No.: WO00/07901

PCT Pub. Date: Feb. 17, 2000

(30) Foreign Application Priority Data

Aug. 3, 1998 (WO) ..... PCT/GB98/02328

(51) Int. Cl.[7] ..... B65D 37/00
(52) U.S. Cl. ..... 222/212; 222/496
(58) Field of Search ..... 222/131, 212, 222/213, 481, 482, 494, 495, 496

(56) References Cited

U.S. PATENT DOCUMENTS

| | | | | | |
|---|---|---|---|---|---|
| 2,628,004 | A | * | 2/1953 | Schlicksupp | 222/495 |
| 3,321,114 | A | * | 5/1967 | Croyle | 222/495 |
| 4,739,906 | A | * | 4/1988 | LoTurco | 222/212 |
| 5,197,638 | A | * | 3/1993 | Wood | 222/212 |

* cited by examiner

*Primary Examiner*—William C. Doerrler
*Assistant Examiner*—Thach H. Bui
(74) *Attorney, Agent, or Firm*—Larson & Taylor PLC

(57) ABSTRACT

A container for dispensing liquids includes a body member and a closure therefor. The closure includes a cap in the form of a plastic moulding having an outlet and a control valve within the cap. The control valve is a one piece plastic moulding having a diaphragm portion and a nose portion. The nose portion normally seals the outlet but is displaceable therefrom on distortion of the diaphragm portion resulting from pressurization of the interior of the body member and whereby liquid is dispensed through the outlet. The cap further includes an annular seating for the control valve which is of hollow, open-ended, generally cylindrical shape, the diameter of which is on the same order to that of the diaphragm portion of the control valve.

16 Claims, 3 Drawing Sheets

CONTAINER VALVE

TECHNICAL FIELD

This invention relates to containers, and more particularly to containers for dispensing pastes, gels, creams and other products hereinafter referred to as liquids.

BACKGROUND

It is often desirable to be able to dispense controlled quantities of liquid from an elongate container, tube or the like through an outlet in the cap of the container at an angle to the direction of flow of liquid from the container to the cap, rather than through an outlet in the top of the container, and in a wiping action directly onto the skin, for example the arm or leg, for subsequent rubbing into the skin for treatment purposes.

Such a wiping action is most conveniently achieved by using a container having a relatively long neck and a narrower cap to provide an ergonomic profile to the container.

However, the number of such containers available with such angled side outlets is limited, while those that are currently available suffer from a number of disadvantages, not the least of which are that the dispensing mechanisms thereof are of relatively complex construction and are expensive to manufacture.

For example, U.S. Pat. No. 5,197,638 discloses a container having a nozzle provided with an outlet which dispenses the contents of the associated container in a direction perpendicular to the direction of feed of the content of the container to the nozzle and under the control of a flexible diaphragm. However, the nozzle incorporates a tortuous series of channels/passageways for the flow of fluid to the outlet, while the diaphragm is integral with, or connected to, a piston of complex configuration urged by a spring into a normal rest position sealing the outlet. Clearly such an arrangement is expensive to manufacture and requires careful manual assembly, while it has also been found to suffer from hygiene problems.

DE 29506682 U1 discloses a container having an outlet the longitudinal axis of which intersects the longitudinal axis of the container at an acute angle, typically 30°.

However, the container incorporates a pump for dispensing liquid through the outlet, and is of relatively complex internal construction not suited to an ergonomic profile with a relatively long neck and a narrow cap.

U.S. Pat. No. 4,798,311 discloses a container with a side outlet, dispensing from the outlet being under the control of a valve having a diaphragm portion mounted in a groove in the head of the container and held in a closed position by a movable cap release of which allows dispensing of liquid through the outlet.

Such a container suffers from a number of disadvantages not the least of which are the complex construction and difficulty of assembly, while dispensing requires movement of the cap to a release position to permit displacement of the valve from the outlet on squeezing of the associated container.

Reference is also made to U.S. Pat. No. 4,798,311, CH 225084 and U.S. Pat. No. 2,170,588 all of which disclose containers with outlets in the sides thereof, but all of which are also of relatively complex construction, difficult to manufacture and difficult to assemble.

SUMMARY OF THE INVENTION

It would be desirable to be able to provide a container capable of controlled dispensing of liquid from a side outlet therein, and of a simpler, more hygienic construction and more economically manufactured than heretofore, preferably suitable for automated assembly to enable efficient high volume production.

According to the present invention there is provided a container comprising a body member for containing liquid and a neck at one end thereof through which liquid flows on pressurization of the interior of the body member, and a closure for the body member including a cap located on the neck of the body member and having an outlet therein for dispensing therethrough liquid flowing through the neck of the body member, and a control valve located within the cap for controlling the dispensing of liquid flowing from the body member to the outlet from the cap, the control valve being a one piece plastic moulding including a diaphragm portion and a nose portion extending from one side of said diaphragm portion, and having a rest position in which the nose portion engages in, to seal, the outlet from the cap, the outlet being in one sidewall of the cap, the cap including an annular seating for the control valve formed on or mounted on a sidewall of the cap opposite that in which the outlet is provided, the arrangement being such that, on pressurization of the interior of the body member, liquid from the body member flows through the neck of the body member into the cap to engage with the one side of the diaphragm portion to distort said diaphragm portion whereby the nose portion of the valve is displaced from the outlet and liquid is dispensed therethrough, and, on subsequent release of pressure from the interior of the body member, the control valve returns, under the influence of its inherent resiliency and atmospheric pressure, to its rest position with the nose portion thereof seating in, to seal, the outlet, characterized in that the seating projects inwardly of the cap from said opposed sidewall towards the outlet and is of hollow, open-ended generally cylindrical shape the central axis of which extends through the outlet in the cap and the diameter of which is substantially equal to that of the diaphragm portion of the control valve, the control valve being mounted on the end of the seating remote from said opposite sidewall with the diaphragm portion thereof sealing said end of the seating and whereby the other side of the diaphragm portion remote from the nose portion is subjected to atmospheric pressure.

It will be appreciated that, with such an arrangement, the closure for the body member can be of extremely simple construction and can comprise a minimal number of individual components which can be readily manufactured by plastic moulding techniques, and automatically assembled.

In particular the provision of a seating having a diameter substantially equal to that of the diaphragm portion of the control valve ensures that the diaphragm portion is not impeded in any way by the cap on distortion of the diaphragm portion to enable dispensing of liquid from the container, and also facilitates overmoulding of the control valve on the seating, in that one of the metal dies or inserts associated with the moulding process can readily be passed through the hollow bore of the seating from the exterior of the closure.

In a preferred embodiment of the invention, the outlet is formed in a plate portion movable relative to the remainder of the cap between a normal position completing the cap and a displaced position providing access to the interior of the cap and to the control valve.

The plate portion may be integrally moulded with the remainder of the cap and movable relative thereto by means of a hinge, or may be separate from the remainder of the cap and a snap fit into an associated aperture in the remainder of the cap to complete assembly of the container and to create a product flow chamber therein.

It will be appreciated that the provision of the open-ended seating in combination with the movable plate portion permits ready overmoulding of the control valve on the seating, in that the opposed metal dies or inserts for forming the valve can be inserted one through the seating and the other through the open plate portion.

In a further embodiment of the invention, the annular seating is separate from, and is a push-fit into a corresponding aperture in, the cap, the control valve seating on, to seal the seating.

With such an arrangement, the control valve can be sealingly mounted on the seating prior to location of the seating in the cap, in particular the control valve can be overmoulded on the seating prior to said location.

The control valve may include a cylindrical skirt portion one end of which is closed by the other side of the diaphragm portion remote from the nose portion, the skirt portion surrounding the seating.

The closure may include a plug member adapted to be a friction fit within the cap to engage the other side of the diaphragm portion of the control valve remote from the nose portion and to retain the nose portion in its rest position engaging in, to seal, the outlet, such an arrangement serving to prevent inadvertent dispensing from the container.

Conveniently, the plug member is integrally moulded with the cap and is pivotal relative thereto about a reduced thickness hinge between an operative position engaging the diaphragm portion of the valve and a released position displaced from the control valve.

The closure may be integrally moulded with the body member to form a continuation of the neck of said body member.

DESCRIPTION OF THE PREFERRED EMBODIMENTS

Figure 1:
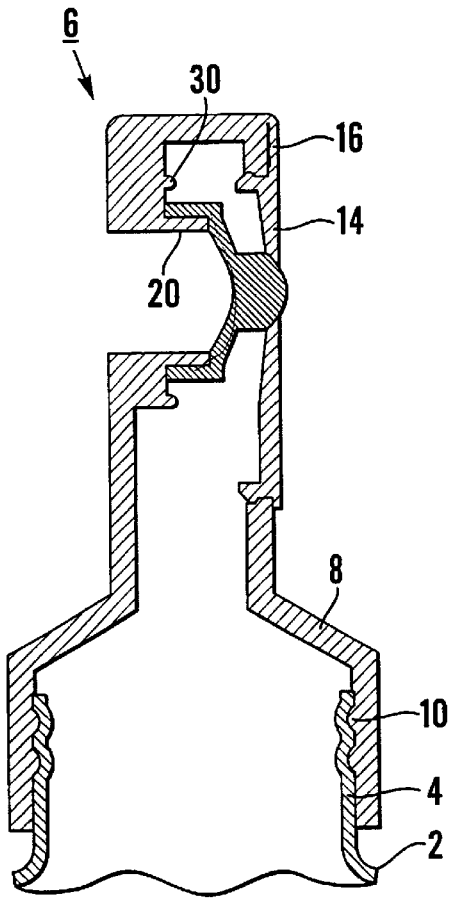
FIGS. 1 and 2 are vertical sections through part of a first container according to the invention the closure for which includes a plate portion, with the plate portion in its normal position and its displaced position respectively.
Figure 2:
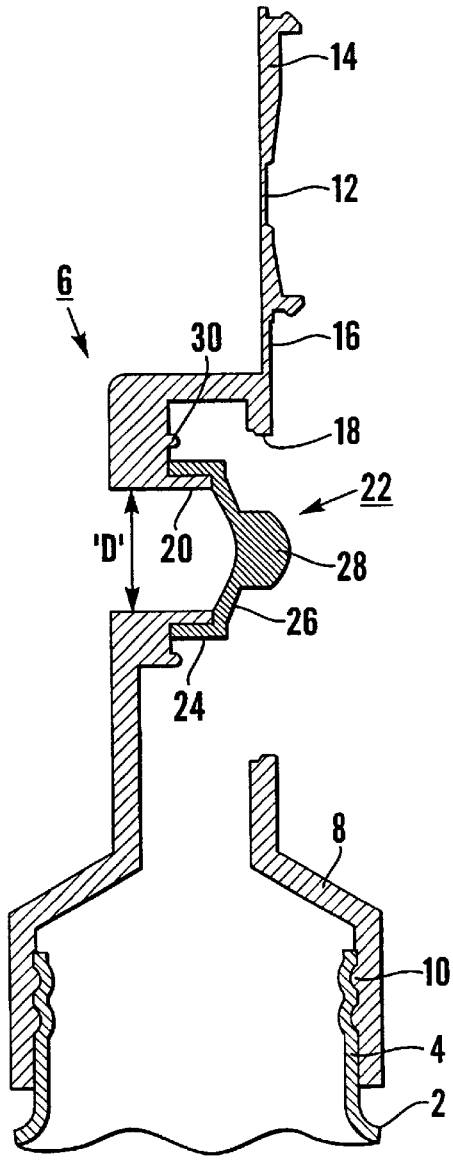

Referring to FIGS. 1 and 2 there is shown part of a container comprising a body portion or reservoir 2 of a flexible plastics material, and including a reduced-diameter, externally threaded neck 4.

Figure 5:
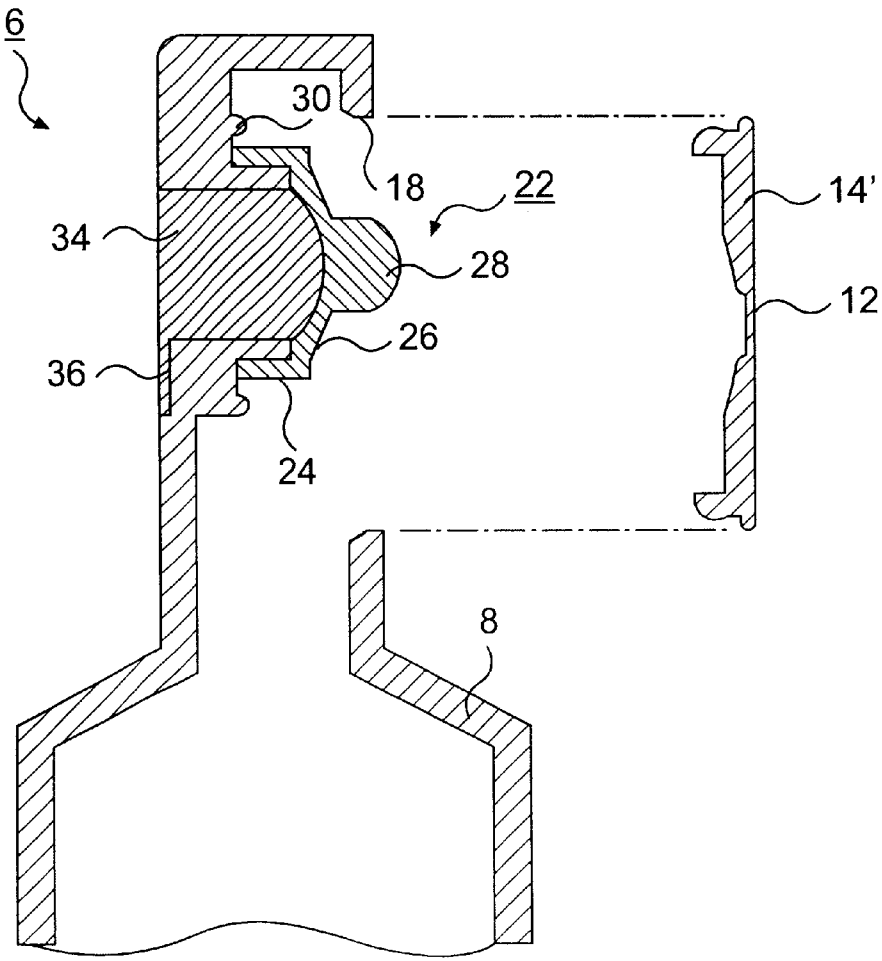
FIG. 5 is a vertical section through part of a third integral container according to the invention having a removable plug and removable plate.

A closure for the body member 2 is indicated generally at 6 and includes a hollow cap 8 moulded from a semi-rigid plastics material such as polythene or polyethylene. The cap 8 has an internally threaded skirt 10 at its lower regions for co-operation with the thread on the neck 4 to locate the closure 6 on the body member, although this location could be effected by means of a snap fit between. the components or by the closure 6 being integrally moulded with the body member 2 as shown in FIG. 5.

The upper regions of the cap 8 are of reduced diameter and include an outlet 12 in a sidewall thereof. More particularly, the outlet 12 is formed in a plate portion 14 forming part of the sidewall of the cap 8 but being mounted to the remainder of the cap 8 by means of a reduced thickness hinge 16 whereby the plate portion 14 can be pivoted between a normal operative position shown in FIG. 1 in which it is a sealing snap fit in a corresponding aperture 18 formed in the cap 8, and an open position shown in FIG. 2 displaced from said aperture 18 and providing access to the interior of the cap 8. Alternatively the plate portion 14 may be separate from the remainder of the cap 8 and not connected thereto by a hinge or other means but rather snap fit as shown by plate portion 14' in FIG. 5.

Integrally moulded in the cap 8 opposite the outlet 12 is a hollow, open-ended cylindrical seating 20 of diameter 'D' which extends radially into the upper regions of the cap 8, the central axis of the seating 20 being perpendicular to the central axis of the neck 4 of the body member 2, said central axis of the seating 20 passing through the outlet 12, the hollow bore through the seating 20 interconnecting the interior of the cap 8 with the atmosphere. It is however to be emphasised that the central axis of the seating 20 may be other than perpendicular to the central axis of the neck 4.

The closure 6 further includes a control valve indicated generally at 22 and comprising an annular skirt portion 24 one end of which is closed by a circular diaphragm portion 26 on the surface of which remote from the skirt portion 24 is formed a central nose portion 28. The valve 22 is integrally moulded from a soft thermoplastic material, or an elastomer or a silicone rubber with the skirt portion 24 being sealingly located on the seating 20 whereby the diaphragm portion 26 defines a barrier between the interior of the cap 8 and the atmosphere. The skirt portion 24 may be a friction fit on the seating 20 or may be moulded thereto to be integral with the cap 8 as will be explained in more detail below.

In the rest position of the valve 22, the nose portion 28 thereof is urged into, to seal, the outlet 18, with atmospheric pressure being applied to the surface of the diaphragm portion 26 remote from the nose portion 28.

In order to dispense the content of the container, the body portion 2 thereof is squeezed to pressurise the interior of the container. This increase in pressure forces the content of the container through the neck 4 into the closure 6 and into forcible engagement with the surface of the diaphragm portion 26 carrying the nose portion 28.

The diaphragm portion 26 is thus displaced to the left as viewed in FIG. 1 whereby the nose portion 28 is displaced from the outlet 12, and the content of the container is dispensed through said outlet 12.

Conveniently this dispensing is accompanied by a downward movement of the container with the outlet 12 against the skin of a user whereby the liquid, for example moisturising cream or sun-tanning cream, is deposited on the skin of the user for subsequent rubbing therein.

On release of the squeezing pressure from the body member 2, and by virtue of its inherent resiliency and the application of atmospheric pressure on the surface of the diaphragm portion 26 remote from the nose portion 28, the control valve returns to the normal rest position seating in and sealing the outlet 12, thereby terminating dispensing of the content from the container.

As can be seen in the drawings, the diameter of the diaphragm portion 26 of the control valve 22 is substantially equal to that of the seating 20 whereby movement of the diaphragm portion 26 from its normal rest position to its distorted position to enable dispensing of liquid is not impeded in any way by the configuration of the cap 8.

Furthermore, the provision of the hollow seating 20 of diameter 'D' in combination with the moveable plate portion 14 enables ready overmoulding of the control valve 22 on the seating 20. More particularly, the opposed metal dies or inserts for the moulding process can be inserted one through the seating 20 and the other through the open aperture 18 to enable moulding to be carried out. Conveniently the inner wall of the cap 8 is provided with location means 30 thereon for positioning the other metal insert during the moulding process.

It will be appreciated that the described container is of relatively simple and therefore inexpensive construction, and is particularly suited to automated assembly and large volume production.

The provision of the outlet 12 in the side of the closure 6, as distinct from the end thereof, makes the container of the invention particularly suited to the application of the content thereof to the skin with the aforementioned wiping action, such application ensuring all the dispensed liquid is deposited on the skin with the wiping action serving to remove all liquid from the exterior of the outlet and ensuring cleanliness and improved hygiene compared with equivalent containers.

Figure 3:
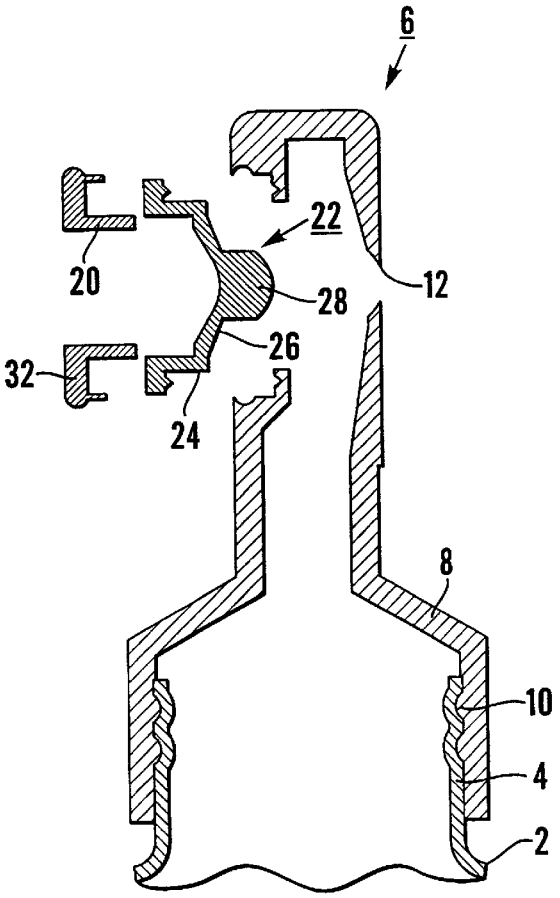
FIGS. 3 and 4 are vertical sections through part of a second container according to the invention, prior to assembly and subsequent to assembly respectively of the associated closure.
Figure 4:
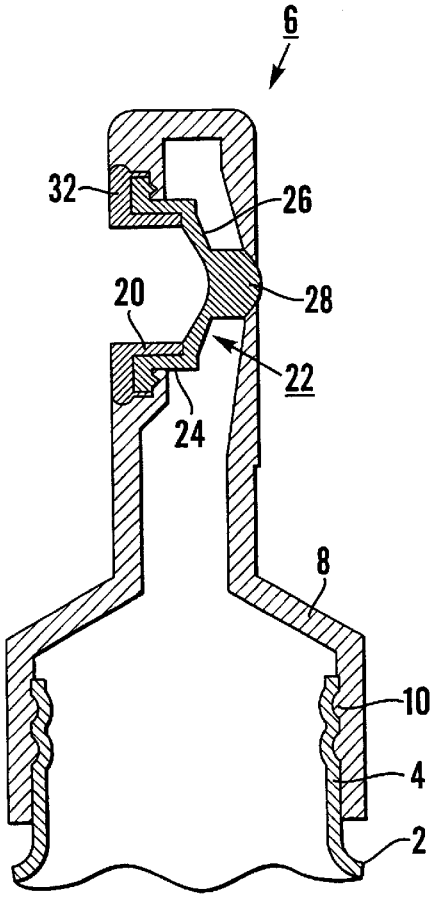
Figure 6:
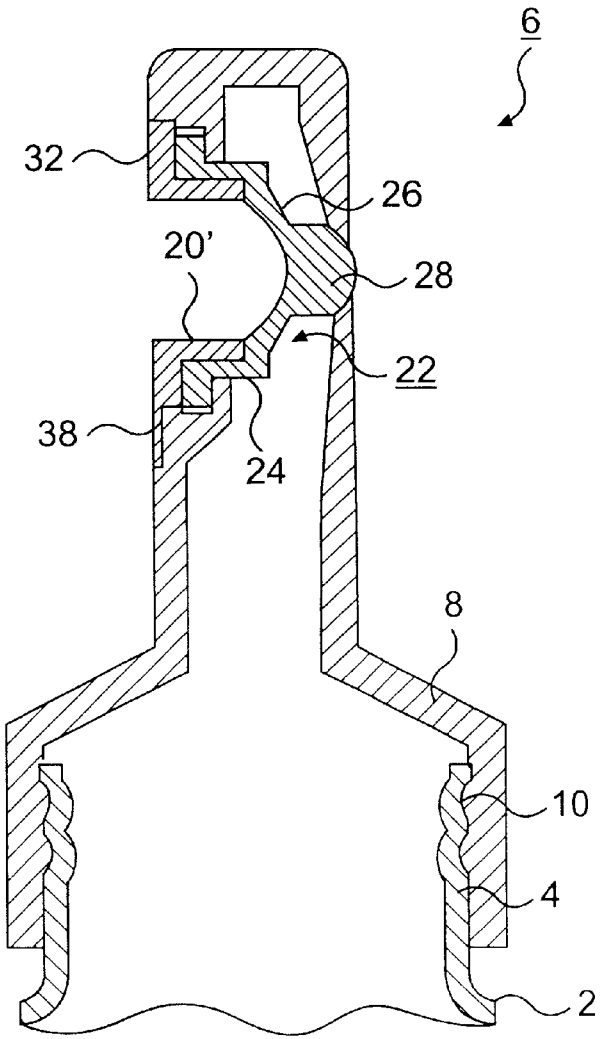
FIG. 6 is a vertical section through part of a fourth container according to the invention having a hinged insert and removable plate.

FIGS. 3 and 4 show a further embodiment of the invention in which the seating 20 is separate from the cap 8 and is embodied in a unitary insert 32 which, together with the control valve 22 mounted thereon, is a push snap-fit into a corresponding aperture in the sidewall of the cap 8 opposite the outlet 12. The pivotal plate portion 14 has been dispensed with, the outlet 12 being formed directly in the cap 8. Alternatively, as shown in FIG. 6, the cap can include an annular seating 20' for the control valve formed on a sidewall of the cap opposite that in which the outlet is provided and hinged thereto by hinge 38.

The provision of the separate insert 32 enables the control valve 22 to be mounted thereon prior to final assembly of the closure 6. The control valve may be a friction sealing fit on the seating, or may be overmoulded thereon without restriction, it not being necessary to provide access to the valve 22 from the outlet side of the cap 8—hence the ability to dispense with the plate portion 14. The insert 32 may be integrally moulded with the cap 8 and attached thereto by means of a reduced thickness hinge about which it can be pivoted into position for push snap-fitting into the cap 8.

Inadvertent dispensing frog the container, for example during travelling, may be prevented in any one of a number of different ways. For example, the closure 6 may be provided with a plug 34 as shown in FIG. 5, which is a tight friction fit in the volume defined by the seating 20 and the surface of the diaphragm portion 26 remote from the nose portion 28, said plug engaging said surface of the diaphragm portion 26 to prevent deflection of the diaphragm portion 26 until the plug 32 is removed from the volume. Conveniently the plug 34 is integrally moulded with the cap 8 and is connected thereto by a reduced thickness hinge 36 to enable movement of the plug 32 into and out of its operative position in engagement with the valve 22.

Clearly the precise construction of the containers could differ from those described and illustrated without departing from the scope of the invention. For example, the container may include a number of outlets 12 and a corresponding number of control valves 22, each outlet having a number of bristles associated therewith externally of the cap whereby the content of the container can be applied in the manner of a brush, while the configuration of the control valve, in particular the nose portion 28 thereof, may be altered. In all embodiments of the invention, it is preferred that, in its normal rest position, the nose portion of the valve extends right through the outlet whereby no liquid can remain in said outlet after use of the container. The end of the nose portion of the valve may also extend right through the outlet even in the open position of the valve, whereby liquid dispensed through the outlet, for example nail varnish, may be applied by the end of the nose portion.

Thus there is described a container of relatively simple construction capable of economic production and automated assembly that provides the consumer with numerous advantages compared with currently available products.

In particular, the container of the invention enables the consumer to dispense smooth, measured quantities either in small doses or large doses and regardless of the viscosity of the liquid.

The sizes of the outlets and the valves can readily be altered to suit different products and the dispensing requirements of the consumer, and can accommodate a wide range of products from highly viscous pastes right through to water, while rapid return of the squeezed container to its normal rest condition is ensured.

The invention is particularly, though not exclusively, applicable to tubes for dispensing relatively viscous pastes and the like.

What is claimed is:

1. A container comprising:

a body member for containing liquid and including a neck at one end thereof through which liquid flows on pressurization of an interior of the body member, and a closure for the body member including a cap located on the neck of the body member and having an outlet therein in a first sidewall portion for dispensing therethrough liquid flowing through the neck of the body member, and a control valve located within the cap for controlling the dispensing of liquid flowing from the body member to the outlet from the cap, the control valve being a one piece plastic moulding including a diaphragm portion and a nose portion extending from one side of said diaphragm portion, and having a rest position in which the nose portion engages in, to seal, the outlet from the cap, wherein the cap includes an annular seating for the control valve, the annular seating being formed on or mounted on a second sidewall portion of the cap opposite the first portion in which the outlet is provided, such that, on pressurization of the interior of the body member, liquid from the body member flows through the neck of the body member into the cap to engage with the one side of the diaphragm portion to distort said diaphragm portion whereby the nose portion of the control valve is displaced from the outlet and liquid is dispensed therethrough, and, on subsequent release of pressure from the interior of the body member, the control valve returns, under the influence of its inherent resiliency and atmospheric pressure, to its rest position with the nose portion thereof seating in the outlet to seal the outlet, wherein the annular seating is spaced from an interior surface of a top wall of the cap, projects inwardly of the cap from an interior surface of said second sidewall portion towards the outlet, is of a hollow, open-ended generally cylindrical shape with a central axis which extends through the outlet in the cap, and has a diameter of which is about a same magnitude as that of the diaphragm portion of the control valve, and wherein the control valve is mounted on an end of the annular seating remote from said second sidewall portion with the diaphragm portion thereof sealing said end of the annular seating and whereby the other side of the diaphragm portion remote from the nose portion is subjected to atmospheric pressure.

2. A container as claimed in claim 1 in which the outlet is formed in a plate portion movable relative to the remainder of the cap between a normal closed position completing the cap and a displaced open position providing access to the interior of the cap and to the control valve.

3. A container as claimed in claim 2 in which the plate portion is integrally moulded with the remainder of the cap and is movable relative thereto by a hinge.

4. A container as claimed in claim 2 in which the plate portion is separate from the remainder of the cap and is a snap fit into an associated aperture in the remainder of the cap.

5. A container as claimed in claim 1 in which the annular seating is separate from, and is a push-fit into a corresponding aperture in, the cap, and in which the control valve seats on the annular seating to seal the seating.

6. A container as claimed in claim 5 in which the annular seating is interconnected with the cap by a hinge.

7. A container as claimed in claim 5 in which the control valve is sealingly mounted on the seating prior to location of the seating in the cap.

8. A container as claimed in claim 1 in which the control valve is overmoulded on the seating.

9. A container as claimed in claim 1 in which the control valve includes a cylindrical skirt portion one end of which is closed by the other side of the diaphragm portion remote from the nose portion, the skirt portion surrounding the seating.

10. A container as claimed in claim 1 in which the closure includes a plug member adapted to be a friction fit within the cap to engage the other side of the diaphragm portion of the control valve remote from the nose portion and in which the plug member retains the nose portion, in its rest position, engaging in the outlet to seal the outlet.

11. A container as claimed in claim 10 in which the plug member is integrally moulded with the cap and is pivotal relative thereto about a reduced thickness hinge between an operative position engaging the diaphragm portion of the valve and a released position displaced from the control valve.

12. A container as claimed in claim 1 in which the closure is integrally moulded with the body member to form a continuation of the neck of said body member.

13. A method of manufacturing a container as claimed in claim 2 comprising the steps of moving the plate portion to its displaced open position, inserting the control valve through the open plate portion and onto, to seal, the seating, and moving the plate portion back to its normal closed position.

14. A method of manufacturing a container as claimed in claim 2 comprising the steps of moving the plate portion to its displaced open position, overmoulding the control valve on the seating by inserting opposed metal inserts one through the seating and the other through the open plate portion to form a mould, removing the metal inserts, and moving the plate portion back to its normal closed condition.

15. A method of manufacturing a container as claimed in claim 5 comprising the step of mounting the control valve on, to seal, the separate seating, and pushing the seating and control valve thereon into the corresponding aperture in the cap.

16. A method as claimed in claim 15 in which the control valve is overmoulded on the seating.

* * * * *